US008717271B2

(12) United States Patent
Kwon et al.

(10) Patent No.: US 8,717,271 B2
(45) Date of Patent: May 6, 2014

(54) LIQUID CRYSTAL DISPLAY HAVING AN INVERSE POLARITY BETWEEN A COMMON VOLTAGE AND A DATA SIGNAL

(75) Inventors: Myoung-Ho Kwon, Yongin (KR); David Lee, Yongin (KR); Chang-Kil Lee, Yongin (KR); Ryu-Hwa Sung, Yongin (KR)

(73) Assignee: Samsung Display Co., Ltd., Giheung-Gu, Yongin, Gyeonggi-Do (KR)

( * ) Notice: Subject to any disclaimer, the term of this patent is extended or adjusted under 35 U.S.C. 154(b) by 261 days.

(21) Appl. No.: 13/204,866

(22) Filed: Aug. 8, 2011

(65) Prior Publication Data

US 2012/0162183 A1 Jun. 28, 2012

(30) Foreign Application Priority Data

Dec. 28, 2010 (KR) ..... 10-2010-0137213

(51) Int. Cl.
*G09G 3/36* (2006.01)

(52) U.S. Cl.
USPC ..... 345/96; 345/209

(58) Field of Classification Search
USPC ..... 345/96, 209
See application file for complete search history.

(56) References Cited

U.S. PATENT DOCUMENTS

| | | | | |
|---|---|---|---|---|
| 5,151,689 | A | 9/1992 | Kabuto et al. | |
| 6,320,566 | B1 | 11/2001 | Go | |
| 2003/0189537 | A1 | 10/2003 | Yun | |
| 2009/0102997 | A1 * | 4/2009 | Wen et al. | 349/54 |
| 2009/0219238 | A1 * | 9/2009 | Furuya et al. | 345/87 |
| 2010/0156868 | A1 * | 6/2010 | Hirayama | 345/208 |

FOREIGN PATENT DOCUMENTS

| | | |
|---|---|---|
| KR | 10-0242110 | 11/1999 |
| KR | 10-0859467 | 9/2008 |
| KR | 10-2009-0059327 | 6/2009 |

* cited by examiner

*Primary Examiner* — Long D Pham
(74) *Attorney, Agent, or Firm* — Robert E. Bushnell, Esq.

(57) ABSTRACT

A liquid crystal display (LCD) and a driving method thereof. The LCD includes: a liquid crystal panel which includes a plurality of pixels formed in intersection areas between a plurality of gate lines and a plurality of data lines, wherein a pair of adjacent pixels share the same data line and are located between a pair of gate lines; a common voltage generator which shifts and outputs a common voltage signal having a polarity, which is reversed one time for a period time and repeated consecutively two time for a ½ period time, for a predetermined time; and a source driver which synchronizes a data signal of a line inversion system with an output timing of the common voltage signal and outputs the data signal to an opposite polarity to a polarity of the common voltage signal to drive the plurality of pixels in a dot inversion system.

16 Claims, 10 Drawing Sheets

| | | | | | | | |
|---|---|---|---|---|---|---|---|
| + | + | + | + | + | + | + | + |
| − | − | − | − | − | − | − | − |
| + | + | + | + | + | + | + | + |
| − | − | − | − | − | − | − | − |
| + | + | + | + | + | + | + | + |
| − | − | − | − | − | − | − | − |
| + | + | + | + | + | + | + | + |
| − | − | − | − | − | − | − | − |

FIG. 3B

| | | | | | | | |
|---|---|---|---|---|---|---|---|
| − | − | − | − | − | − | − | − |
| + | + | + | + | + | + | + | + |
| − | − | − | − | − | − | − | − |
| + | + | + | + | + | + | + | + |
| − | − | − | − | − | − | − | − |
| + | + | + | + | + | + | + | + |
| − | − | − | − | − | − | − | − |
| + | + | + | + | + | + | + | + |

FIG. 4A

| | | | | | | | |
|---|---|---|---|---|---|---|---|
| + | − | + | − | + | − | + | − |
| − | + | − | + | − | + | − | + |
| + | − | + | − | + | − | + | − |
| − | + | − | + | − | + | − | + |
| + | − | + | − | + | − | + | − |
| − | + | − | + | − | + | − | + |
| + | − | + | − | + | − | + | − |
| − | + | − | + | − | + | − | + |

FIG. 4B

| | | | | | | | |
|---|---|---|---|---|---|---|---|
| − | + | − | + | − | + | − | + |
| + | − | + | − | + | − | + | − |
| − | + | − | + | − | + | − | + |
| + | − | + | − | + | − | + | − |
| − | + | − | + | − | + | − | + |
| + | − | + | − | + | − | + | − |
| − | + | − | + | − | + | − | + |
| + | − | + | − | + | − | + | − |

LIQUID CRYSTAL DISPLAY HAVING AN INVERSE POLARITY BETWEEN A COMMON VOLTAGE AND A DATA SIGNAL

CLAIM OF PRIORITY

This application makes reference to, incorporates the same herein, and claims all benefits accruing under 35 U.S.C. §119 from an application earlier filed in the Korean Intellectual Property Office on Dec. 28, 2010 and there duly assigned Serial No. 10-2010-0137213.

BACKGROUND OF THE INVENTION

1. Field of the Invention

The present invention relates to a liquid crystal display (LCD), and more particularly, to an LCD capable of driving a liquid crystal panel in a dot inversion system using a driving device for driving a line inversion system and a driving method thereof.

2. Description of the Related Art

A liquid crystal display (LCD) is widely used as a display device of a notebook computer, a portable television, or the like due to its light weight, small size, and low power driving.

The LCD adjusts an amount of transmitted light to display a desired image on a screen. For this purpose, the LCD includes a liquid crystal panel which includes a plurality of pixels arranged in a matrix form, and a driving circuit which drives the liquid crystal panel.

The liquid crystal panel is driven using an inversion driving system such as a frame inversion system, a line inversion system, or a dot inversion system The dot inversion system provides the highest display quality, but its design is more complicated than the line inversion system, and a high voltage or a source driver having two types of polarities are required, thereby increasing the size of an integrated circuit (IC). Accordingly, the price of the IC is increased, and product price competitiveness is weakened.

SUMMARY OF THE INVENTION

The present invention provides a liquid crystal display (LCD) which realizes a liquid crystal panel in a dot inversion system using a line inversion type driving device to provide a high-quality image, a simple design, and price competitiveness, and a driving method thereof.

According to an aspect of the present invention, an LCD comprises: a liquid crystal panel which includes a plurality of pairs of pixels which share the same data line and which are located between a pair of gate lines; a common voltage generator which outputs a common voltage signal having a polarity which is reversed one time for a period time and repeated consecutively two times for a ½ period time; a timing controller which outputs a common voltage control signal which shifts an output timing of the common voltage signal; and a source driver which synchronizes a data signal having a polarity opposite to the polarity of the common voltage with the output timing of the common voltage signal, and which outputs the data signal to each data line.

A pair of gate lines may be formed in each horizontal line of the liquid crystal panel, wherein an odd-numbered one of the pair of pixels is connected to an odd-numbered one of the pair of gate lines, and an even-numbered one of the pair of pixels is connected to an even-numbered one of the pair of gate lines.

The common voltage generator may output the common voltage signal which is shifted by a ¼ period time according to the common voltage control signal. The common voltage signal may be shifted ahead or backwards by a ¼ period time, and then outputted.

The period time may be a time required for driving two horizontal lines.

According to another aspect of the present invention, an LCD comprises: a liquid crystal panel which includes a plurality of pixels formed in intersection areas between a plurality of gate lines and a plurality of data lines, wherein a pair of adjacent pixels share the same data line and are located between a pair of gate lines; a common voltage generator which shifts and outputs a common voltage signal having a polarity which is reversed one time for a period time and repeated consecutively two times for a ½ period time for a predetermined time; and a source driver which synchronizes a data signal of a line inversion system with an output timing of the common voltage signal, and which outputs the data signal with a polarity opposite to the polarity of the common voltage signal so as to drive the plurality of pixels in a dot inversion system.

According to another aspect of the present invention, there is provided a method of driving an LCD, including a liquid crystal panel which includes a plurality of pixels formed in intersection areas between a plurality of gate lines and a plurality of data lines, wherein a pair of adjacent pixels share the same data line and are located between a pair of gate lines. The method comprises: outputting a gate signal sequentially to the plurality of gate lines; shifting a common voltage signal having a polarity which is reversed one time for a period time and repeated consecutively two times for a ½ period time; outputting the shifted common voltage signal to a pixel turned on by the gate signal; and synchronizing a data signal having a polarity opposite to the polarity of the common voltage signal with an output timing of the common voltage signal, and outputting the data signal to the plurality of data lines.

The output of the data signal may include outputting the data signal having a first polarity to a pixel connected to a first gate line, and alternately outputting the data signal having second and first polarities from a pixel connected to a second gate line, wherein the data signal having the second and first polarities are alternately outputted from the pixel connected to the second gate line consecutively two times.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein:

FIG. 2 illustrates the structure of a pixel PX according to an embodiment of the present invention;

FIGS. 3A and 3B illustrate a line inversion driving system of an LCD;

FIGS. 4A and 4B illustrate a dot inversion driving system of an LCD;

DETAILED DESCRIPTION OF THE INVENTION

Figure 1:
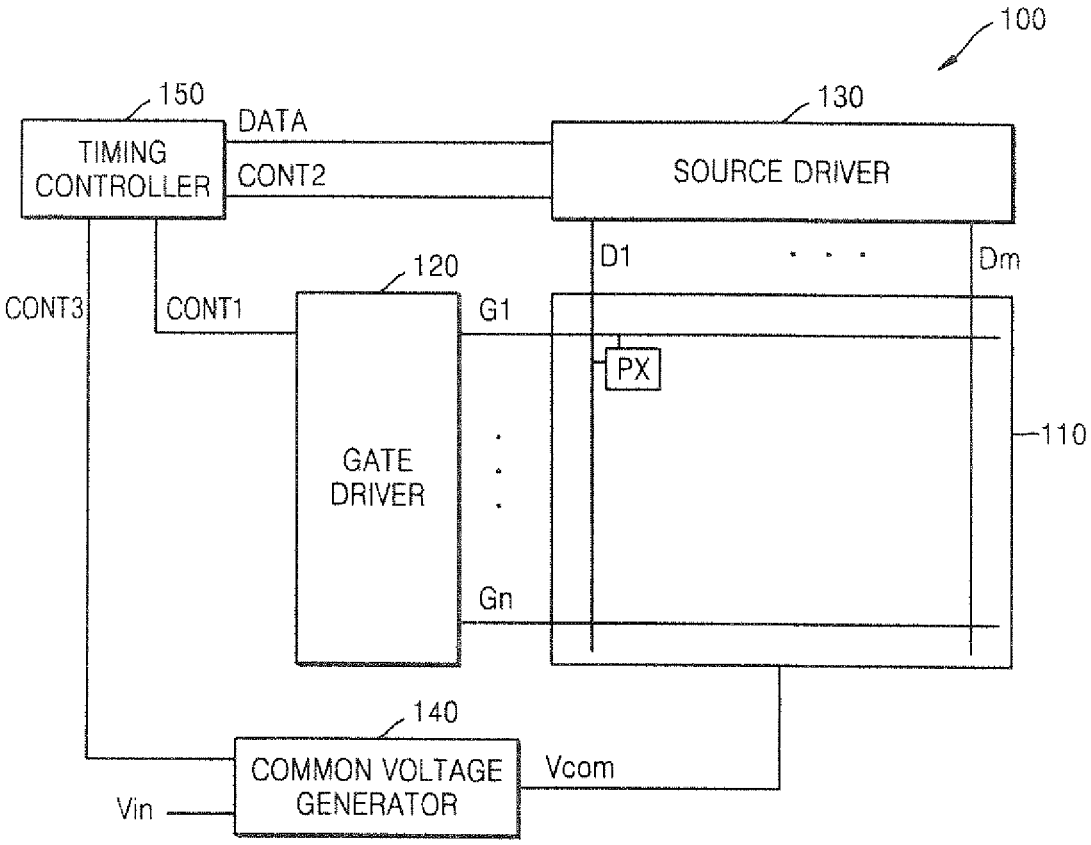
FIG. 1 schematically illustrates the structure of a liquid crystal display (LCD) according to an embodiment of the present invention.

The present invention will now be described more fully with reference to the accompanying drawings, in which exemplary embodiments of the invention are shown. Like reference numerals in the drawings denote like elements. In the description of the present invention, if it is determined that a detailed description of commonly used technologies or structures related to the invention may unnecessarily obscure the subject matter of the invention, the detailed description will be omitted.

It will be understood that, although the terms 'first', 'second', etc. may be used herein to describe various elements, these elements should not be limited by these terms. These terms are only used to distinguish one element from another. For example, a first element could be termed a second element, and, similarly, a second element could be termed a first element, without departing from the scope of exemplary embodiments.

The terminology used herein is for the purpose of describing particular embodiments only, and is not intended to be limiting of exemplary embodiments. As used herein, the singular forms "a," "an," and "the," are intended to include the plural forms as well, unless the context clearly indicates otherwise. It will be further understood that the terms "comprises," "comprising," "includes," and/or "including," when used herein, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which exemplary embodiments belong. It will be further understood that terms, such as those defined in commonly used dictionaries, should be interpreted as having a meaning which is consistent with their meaning in the context of the relevant art, and should not be interpreted in an idealized or overly formal sense unless expressly so defined herein.

Figures 2, 3A:
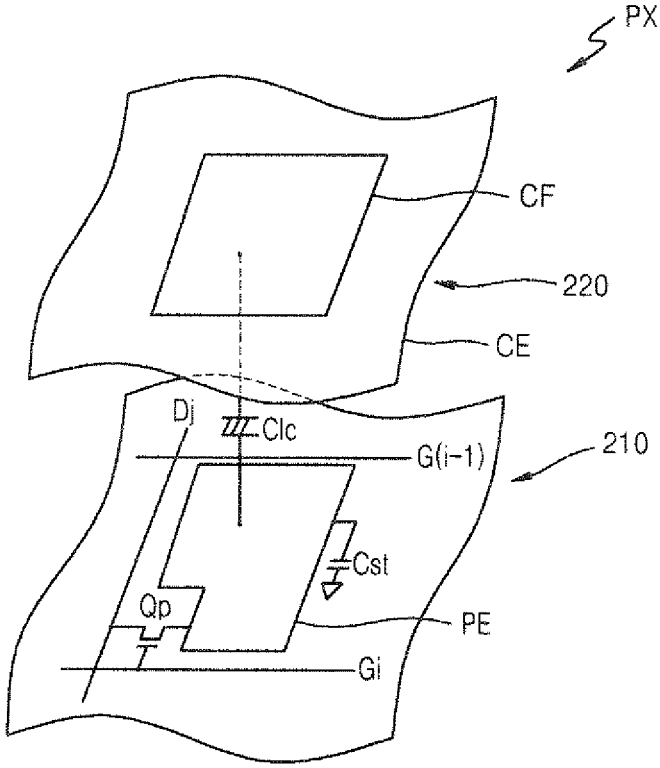

FIG. 1 schematically illustrates the structure of a liquid crystal display (LCD) according to an embodiment of the present invention; and FIG. 2 illustrates the structure of a pixel PX according to an embodiment of the present invention;

Referring to FIG. 1, the LCD 100 includes a liquid crystal panel 110, a gate driver 120, a source driver 130, a common voltage generator 140, and a timing controller 150.

The liquid crystal panel 110 includes a plurality of gate lines G1 thru Gn, a plurality of data lines D1 thru Dm, and a plurality of pixels PX. The plurality of gate lines G1 thru Gn are arrayed at constant distances from one another in columns and respectively transmit gate voltages. The plurality of data lines D1 thru Dm are arrayed at constant distances from one another in rows and respectively transmit data voltages. The plurality of gate lines G1 thru Gn and the plurality of data lines D1 thru Dm are arrayed in a matrix form. Here, one pixel PX is formed at an intersection between each of the plurality of gate lines G1 thru Gn and each of the plurality of data lines D1 thru Dm.

In order to realize a color display, each pixel PX distinctly displays one color of primary colors, or alternately displays the primary colors with time so that a special or temporal sum of the primary colors is recognized as a desired color. Examples of the primary colors include red (R), green (G), and blue (B) colors. Here, if a color is displayed using a temporal sum, R, G, and B colors are temporarily alternately displayed in one pixel so as to realize one color in the one pixel. If a color is displayed using a special sum, one color is realized in three pixels, e.g., in R, G, and B pixels. Therefore, each of the R, G, and B pixels is referred to as a sub-pixel, and three sub-pixels are referred to as one pixel.

The pixels PX will now be described with reference to FIG. 2. The liquid crystal panel 110 includes a liquid crystal layer (not shown) which is formed between first and second substrates 210 and 220, respectively. The plurality of gate lines G1 thru Gn, the plurality of data lines D1 thru Dm, a pixel switching device Qp, and a pixel electrode PE are formed on the first substrate 210. A color filter CF and a common electrode CE are formed on the second substrate 220. Differently from FIG. 2, the color filter CF may be formed on or underneath the pixel electrode PE of the first substrate 210.

For example, the pixel PX, which is connected to the $i^{th}$ (i is a natural number between 1 and n) gate line G1 and the $j^{th}$ (j is a natural number between 1 and m) data line Dj, includes a gate electrode connected to the $i^{th}$ gate line G1, a first electrode connected to the $j^{th}$ data line Dj, the pixel switching device Qp including a second electrode connected to the pixel electrode PE, a liquid crystal capacitor Clc and a storage capacitor Cst coupled to the second electrode of the pixel switching device Qp through the pixel electrode PE.

The liquid crystal capacitor Clc is formed using the pixel electrode PE of the first substrate 210 and the common electrode CE of the second substrate 220 as two electrodes, and includes a liquid crystal layer which operates as a dielectric between the two electrodes. A common voltage Vcom is applied to the common electrode CE. Light transmittance of the liquid crystal layer is adjusted according to a voltage applied to the pixel electrode PE so as to adjust luminance of each pixel PX.

The pixel electrode PE is coupled to the $j^{th}$ data line Dj through the pixel switching device Qp. If the gate electrode is connected to the $i^{th}$ gate line G1, and thus a gate-on voltage Von is applied to the $i^{th}$ gate line G1, the pixel switching device Qp is turned on, thereby applying a data voltage, transmitted through the $j^{th}$ data line Dj, to the pixel electrode PE.

Separate signal lines (not shown) are formed in parallel with the $i^{th}$ gate lines on the pixel electrode PE and the first substrate 210, e.g., storage lines are formed, so as to overlap with each other so that the dielectric is disposed therebetween to form the storage capacitor Cst. The common voltage Vcom or a predetermined voltage for the storage capacitor Cst may be applied to the separate signal lines.

The pixel switching device Qp may be a thin film transistor (TFT) which is formed of amorphous silicon.

Referring to FIG. 1 again, the gate driver 120 generates a gate voltage Vg having a combination of a gate-on voltage Von on an active level and a gate-off voltage Voff on an inactive level, and sequentially supplies the gate voltage Vg to the liquid crystal panel 110 through the plurality of gate lines G1 thru Gn.

The source driver 130 converts input image data DATA, which is inputted from the timing controller 140 and has input gradations, into a data voltage Vd which is a voltage form signal, and sequentially supplies the data voltage Vd to the liquid crystal panel 110 through the plurality of data lines D1 thru Dm. The source driver 130 synchronizes the data voltage Vd of a line inversion system with an output timing of the common voltage Vcom, and outputs the synchronized voltage with a polarity opposite to the polarity of the common voltage Vcom so as to drive the plurality of pixels PE in a dot inversion system.

The common voltage generator 140 receives an input voltage Vin from an external graphic controller (not shown), generates the common voltage Vcom, and supplies the common voltage Vcom to the liquid crystal panel 110. The common voltage generator 140 shifts the common voltage Vcom, having a polarity which is reversed one time for a period time T and repeated consecutively two times for a/1;2 period time, for a predetermined time and outputs the shifted common voltage Vcom to the liquid crystal panel 110.

The timing controller 150 receives the input image data DATA and an input control signal for controlling a display of the input image data DATA from the external graphic controller (not shown). Examples of the input control signal may be a horizontal sync signal Hsync, a vertical sync signal Vsync, and a main clock MCLK. The timing controller 150 transmits the input image data DATA to the source driver 130, generates a gate control signal CONT1 and a data control signal CONT2, and transmits the gate control signal CONT1 and the data control signal CONT2 to the gate driver 120 and the source driver 130, respectively. The gate control signal CONT1 includes a scan start signal for instructing a scan start and a plurality of clock signals. The data control signal CONT2 includes a horizontal sync start signal for instructing a transmission of input image data for pixels PX in one column and a clock signal. The timing controller 150 generates a common voltage control signal CONT3, and transmits the common voltage control signal CONT3 to the common voltage generator 140. The common voltage control signal CONT3 shifts an output timing of a common voltage signal. The timing controller 150 also outputs a polarity control signal. The polarity control signal controls reversals of the common voltage Vcom and the data voltage Vd to reverse a potential difference between the common voltage Vcom and the data voltage Vd in each pixel.

The gate driver 120 and the source driver 130 may be directly formed on the first substrate 210 of the liquid crystal panel 110 using an ASG method, or may be separately formed and mounted on the first substrate 210 using a method such as Chip On Board (COB), Tape Automated Bonding (TAB), or Chip On Glass (COG).

The LCD 100 uses an inversion driving system, such as a frame inversion system, a line inversion system, or a dot inversion system, to drive the pixels on the liquid crystal panel 110.

A liquid crystal panel driving method of the frame inversion system reverses the polarity of a data voltage, which is supplied to pixels on a liquid crystal panel in each frame, so as to prevent liquid crystal deterioration.

FIGS. 3A and 3B illustrate a line inversion driving system of an LCD.

A liquid crystal panel driving method of the line inversion system reverses the polarity of a data voltage, which is supplied to a liquid crystal panel, in each gate line and each frame on the liquid crystal panel, as shown in FIGS. 3A and 3B. Such a line inversion driving system generates flickers, such as striped patterns, among horizontal lines due to an existence of crosstalk between horizontal pixels.

FIGS. 4A and 4B illustrate a dot inversion driving system of an LCD.

A liquid crystal panel driving method of the dot inversion system supplies a data voltage, having an opposite polarity relative to all of horizontally and vertically adjacent pixels, to each of the pixels and reverses the polarity of the data voltage in each frame, as shown in FIGS. 4A and 4B. In other words, if a video signal of an odd-numbered frame is displayed, the dot inversion system proceeds from a left upper pixel to a right sub-pixel, and then to lower pixels, so as to supply a data voltage to each of the pixels so that a positive polarity (+) alternates with a negative polarity (−), as shown in FIG. 4A. If a video signal of an even-numbered frame is displayed, the dot inversion system proceeds from a left upper pixel to a right pixel, and then to lower pixels, so as to supply the data voltage to each of the pixels so that a negative polarity (−) alternates with a positive polarity (+), as shown in FIG. 4B. Such a dot inversion driving method offsets flickers occurring among vertically and horizontally adjacent pixels from one another so as to provide a higher quality image than the other inversion systems.

However, a polarity of a data voltage supplied from a source driver to data lines is to be horizontally and vertically reversed, and the dot inversion driving method requires a high voltage or a source driver having two types of polarities in comparison with the other inversion methods, thereby complicating the design and increasing the size of an IC.

In the present embodiment, a liquid crystal panel is driven in a dot inversion system using a source driver which drives a liquid crystal panel in a line inversion system without an increase in the size of an IC, thereby realizing a high-quality image without a change of the design structure.

Figure 5:
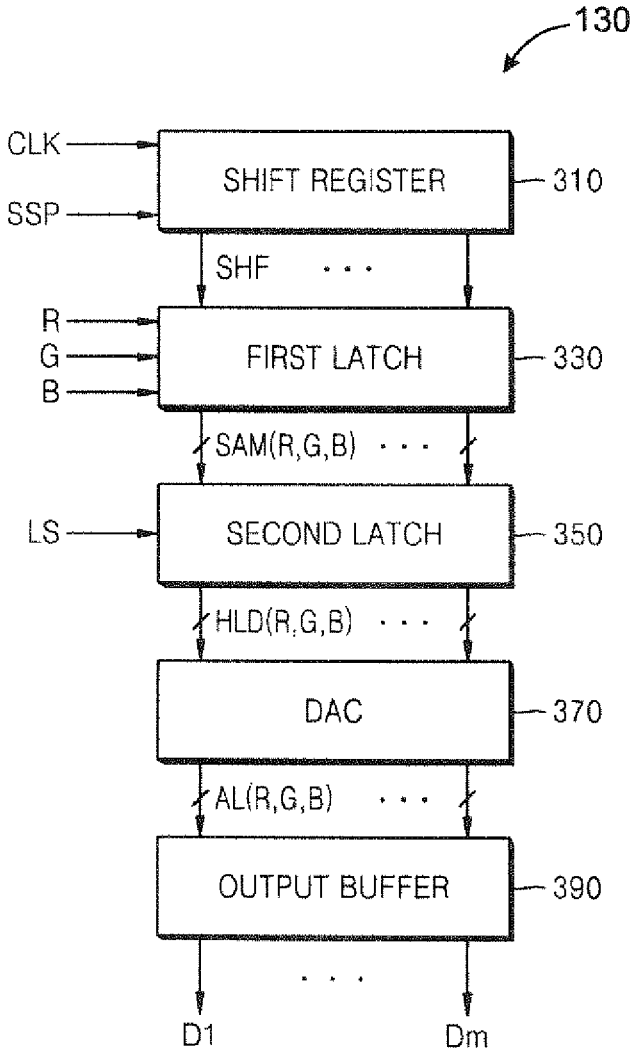
FIG. 5 schematically illustrates the structure of a source driver according to an embodiment of the present invention.

FIG. 5 schematically illustrates the structure of a source driver according to an embodiment of the present invention.

Referring to FIG. 5, the source driver 130 includes a shift register 310, a first latch 330, a second latch 350, a digital-to-analog converter (DAC) 370, and an output buffer 390.

The shift register 310 includes a plurality of flip-flops which are installed to respectively correspond to data lines, and which are sequentially connected to one another in series. The shift register 310 synchronizes with a clock signal CLK to sequentially shift source start pulses SSP to the flip-flops so as to output a shift pulse signal SHF.

The first latch 330 receives digital RGB data, synchronizes with the shift pulse signal SHF outputted to each of the flip-flops, and samples SAM and stores the digital RGB data.

The second latch 350 synchronizes with a latch signal LS to hold HLD the digital RGB data sampled and stored in the first latch 330.

The DAC 370 converts the digital RGB data output from the second latch 350 into analog RGB data AL which is to be supplied to the data lines.

The output buffer 390 buffers the analog RGB data AL outputted from the DAC 370 and outputs the buffered analog RGB data AL to the data lines. The output buffer 390 includes operational amplifier circuits OPC, which are respectively installed in the data lines, and operational amplifiers circuits OPC convert impedance of the analog RGB data AL outputted from the DAC 370, and outputs the analog RGB data AL having the converted impedance to the data lines. The operational amplifier circuits OPC are low voltage positive operational amplifier circuits for driving a line inversion type panel.

Figure 6:
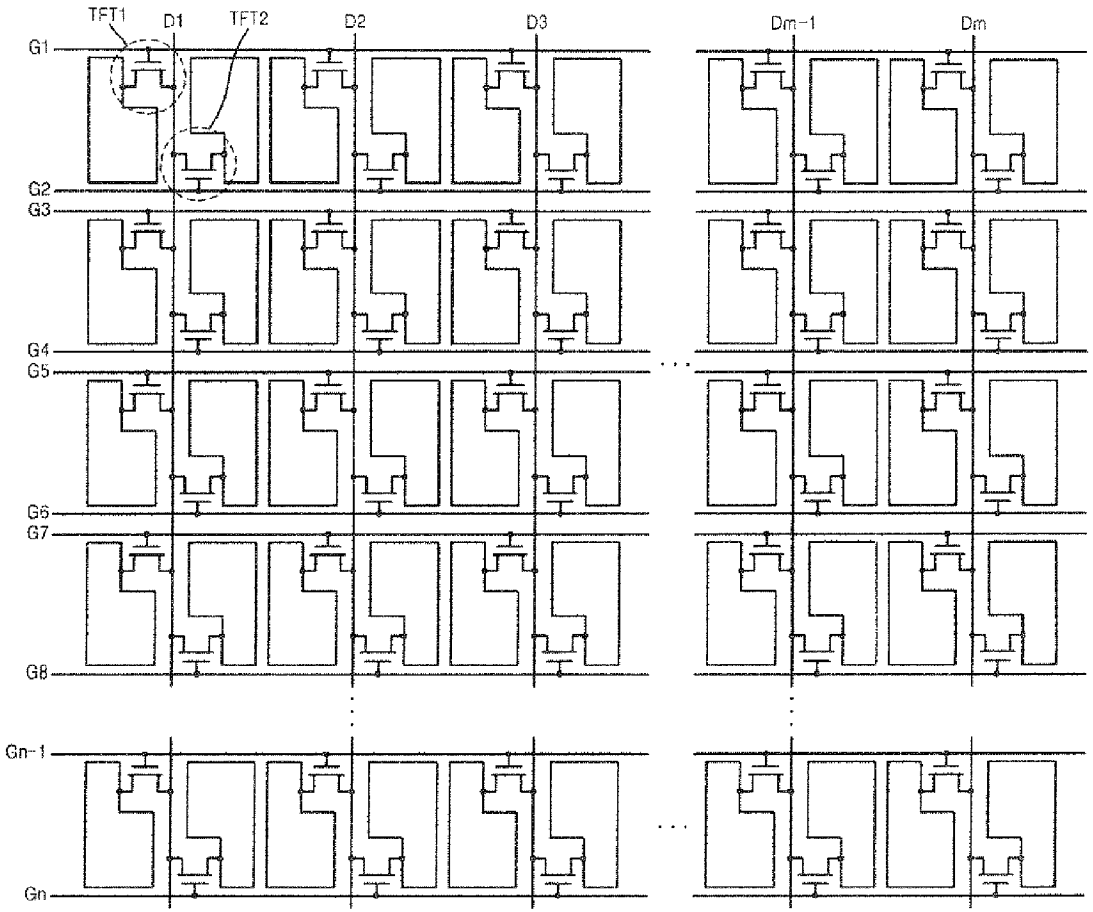
FIG. 6 schematically illustrates a part of a pixel array of a liquid crystal panel according to an embodiment of the present invention.

FIG. 6 schematically illustrates a part of a pixel array of the liquid crystal panel according to an embodiment of the present invention.

Referring to FIG. 6, the pixel array of the liquid crystal panel 110 includes a plurality of R, G, and B sub-pixels which are arrayed in intersection areas between data lines D1 thru Dm and gate lines G1 thru Gn. The R, G, and B sub-pixels respectively include switching devices connected to the gate lines G1 thru Gn and the data lines D1 thru Dm, e.g., TFTs.

The liquid crystal panel 110 includes a plurality of pairs of odd-numbered pixels and a plurality of pairs of even-numbered pixels which share the adjacent gate lines and one data line. Two sub-pixels of the R, G, and B sub-pixels are connected to left and right sides of each horizontal line (row direction) of the data lines D1 thru Dm. The left sub-pixels are connected to the odd-numbered gate lines through first switching devices TFT 1, and the right sub-pixels are connected to even-numbered gate lines through second switching devices TFT2. Therefore, the number of data lines is half of the number of pixels in horizontal lines, and the number of gate lines is double the number of pixels in vertical lines (column direction).

A gate-on voltage Von is sequentially applied to the liquid crystal panel 110 in an order from the first gate line G1 to the $n^{th}$ gate line Gn. The switching device of each sub-pixel is turned on by the gate-on voltage Von, and thus a data voltage is sequentially applied to the sub-pixels in an order from the first data line D1 to the mth data line Dm.

Figure 7A:
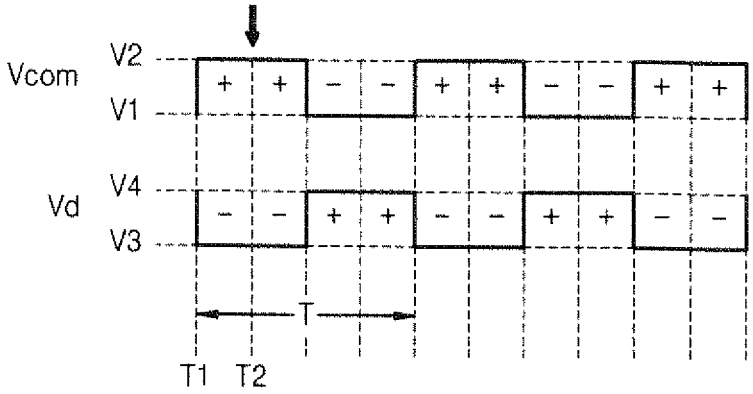
FIGS. 7A and 7B are timing diagrams of a common voltage signal and a data signal applied to a liquid crystal panel according to an embodiment of the present invention.
Figure 7B:
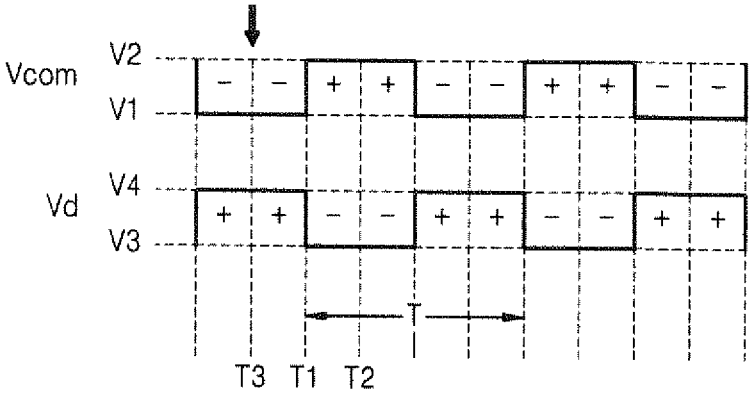

FIGS. 7A and 7B are timing diagrams of a common voltage signal and a data signal applied to a liquid crystal panel according to an embodiment of the present invention.

Referring to FIGS. 7A and 7B, a common voltage Vcom swings first and second voltages V1 and V2, respectively, and reverses polarities of the first and second voltages V1 and V2, respectively, for a first period time T, and outputs voltages having the same type of polarities consecutively two times for each half period time T/2. If the first voltage V1 has a lower voltage level than the second voltage V2, and the first voltage V1 is applied, the common voltage Vcom becomes a negative polarity signal (−). If the second voltage V2 is applied, the common voltage Vcom becomes a positive polarity signal (+).

A data voltage Vd swings third and fourth voltages V3 and V4, respectively, for the first period time T and reverses polarities of the third and fourth voltages V3 and V4, respectively, and outputs voltages having the same type of polarities consecutively two times for each half period time T/2. If the third voltage V3 has a lower voltage level than the fourth voltage V4, and the third voltage V3 is applied, the data voltage Vd becomes a negative polarity signal (−). If the fourth voltage V4 is applied, the data voltage Vd becomes a positive polarity signal (+).

Polarities of the common voltage Vcom and the data voltage Vd are opposite to each other.

Each horizontal (row) line of a liquid crystal panel according to an embodiment of the present invention includes a pair of gate lines. An odd-numbered sub-pixel connected to an odd-numbered one of the pair of gate lines and an even-numbered sub-pixel connected to an even-numbered one of the pair of gate lines make a pair and share one data line, and may be a 4H (Horizontal period). Therefore, the first period time T may be a time required for driving two horizontal lines.

An input timing (or an output timing) of the common voltage Vcom to the liquid crystal panel is shifted before or after a first time T1 by T/4 so as to apply the common voltage Vcom to the liquid crystal panel 110. Also, the polarity of the data voltage Vd is reversed so that the data voltage Vd has an opposite polarity relative to a polarity of the shifted common voltage Vcom.

Also, the polarities of the common voltage Vcom and the data voltage Vd are reversed in each frame.

The input timing of the common voltage Vcom to the liquid crystal panel may be a second time T2 which is shifted before the first time T1 by T/4, as shown in FIG. 7A, or may be a third time T3 which is shifted after the first time T1 by T/4, as shown in FIG. 7B.

Figure 8A:
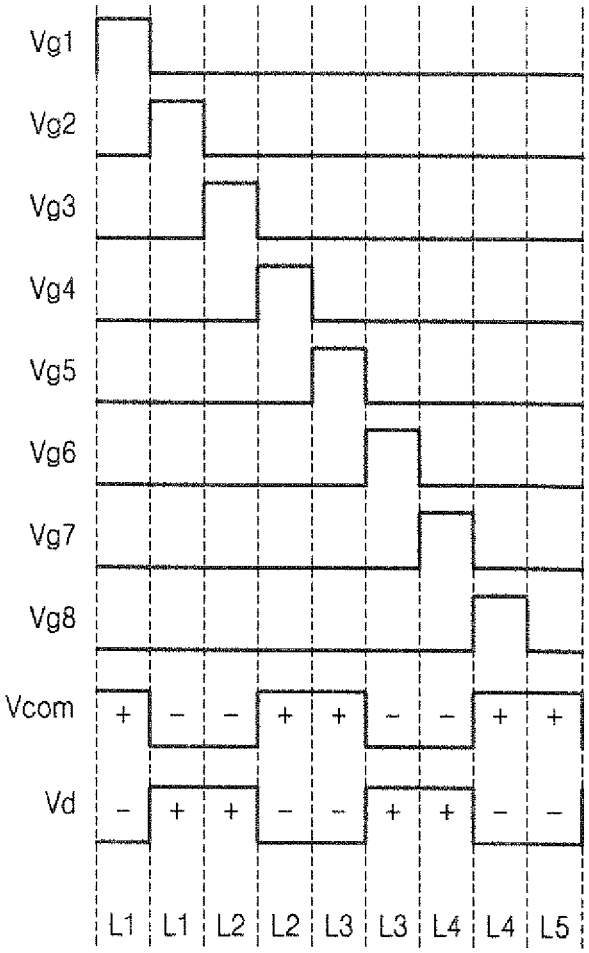
FIGS. 8A and 8B illustrate a method of driving a liquid crystal panel according to an embodiment of the present invention.
Figure 8B:
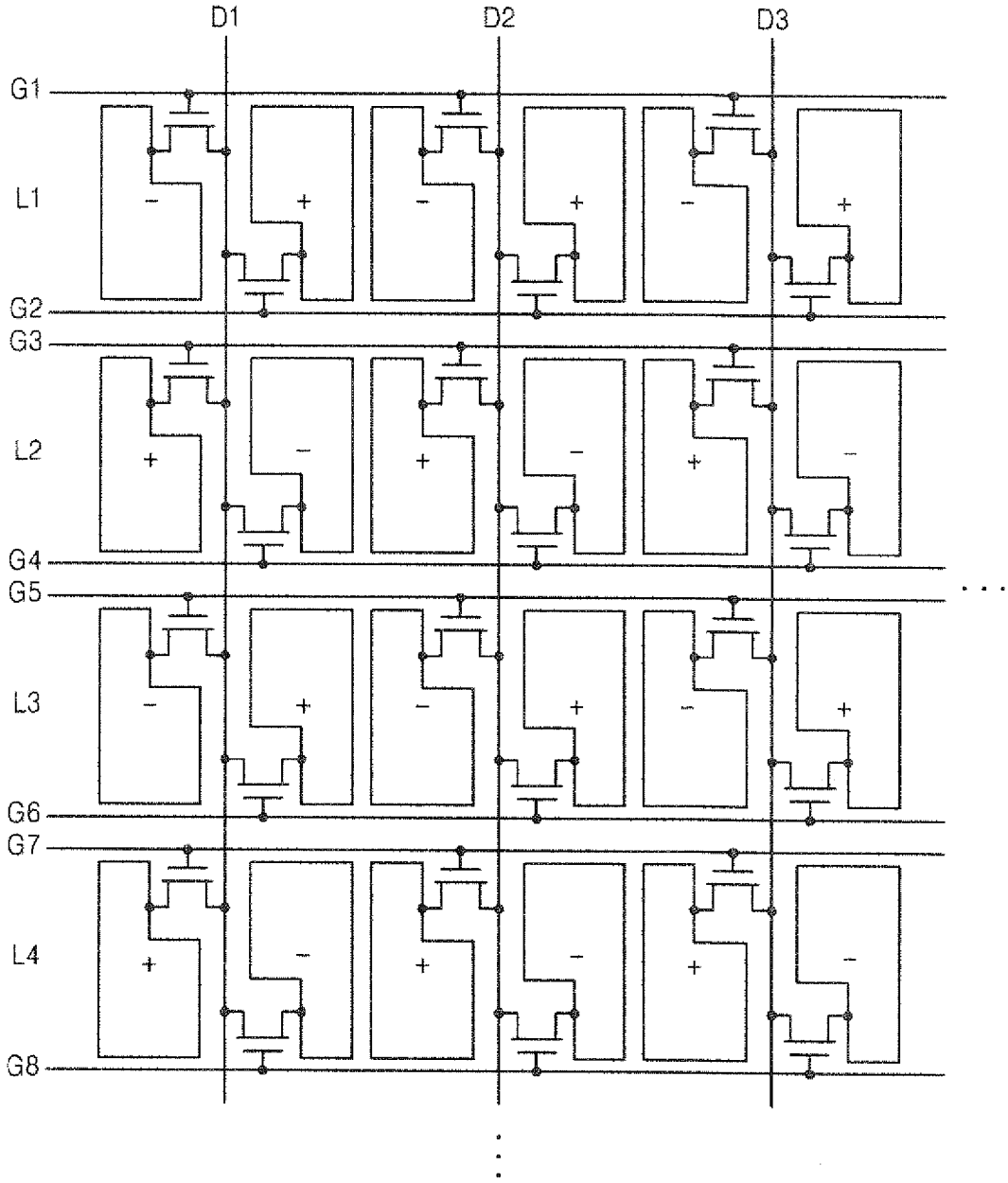

FIGS. 8A and 8B illustrate a method of driving a liquid crystal panel according to an embodiment of the present invention.

Referring to FIGS. 8A and 8B, a gate voltage Vg is sequentially applied from a first gate line G1 to an $n^{th}$ gate line Gn. In FIGS. 8A and 8B, for convenience, first thru eighth gate voltages, Vg1 thru Vg8, sequentially applied to first thru eighth gate lines, G1 thru G8, and first thru third data lines, D1 thru D3, are exemplarily illustrated.

The gate voltage Vg is sequentially applied from the first gate line G1, and thus a switching device is turned on, thereby applying a data voltage Vd to the first thru third data lines, D1 thru D3. Here, the output timing of a common voltage Vcom having a positive polarity (+) is shifted ahead by T/4, and a polarity of the data voltage Vd is reversed so that the data voltage Vd has an opposite polarity relative to the polarity of the shifted common voltage Vcom.

An inversion system according to an embodiment of the present invention will now be described with a pair of odd-numbered and even-numbered pixels connected to left and right sides of the first data line D1. This is equally applied to sub-pixels connected to the other data lines.

The common voltage Vcom having a positive polarity (+) and the data voltage Vd having a negative polarity (−) are applied to an odd-numbered sub-pixel connected to the first gate line G1 of a first horizontal line L1. The common voltage Vcom having a negative polarity (−) and the data voltage Vd having a positive polarity (+) are applied to an even-numbered sub-pixel connected to a second gate line G2 of the first horizontal line L1. The common voltage Vcom having a negative polarity (−) and the data voltage Vd having a positive polarity (+) are applied to an odd-numbered sub-pixel connected to a third gate line G3 of a second horizontal line L2. The common voltage Vcom having a positive polarity (+) and the data voltage Vd having a negative polarity (−) are applied to an even-numbered sub-pixel connected to a fourth gate line G4 of the second horizontal line L2.

Except for the common voltage Vcom and the data voltage Vd outputted to the odd-numbered sub-pixel connected to the first gate line G1, the common voltage Vcom and the data voltage Vd having the same type of polarities are subsequently outputted consecutively two times. Therefore, as shown in FIG. 8B, a dot inversion driving method for alternately applying the data voltage Vd having positive polarities (+) and negative polarities (−) between adjacent sub-pixels using the same power consumption as a line inversion driving method may be realized.

Figure 9A:
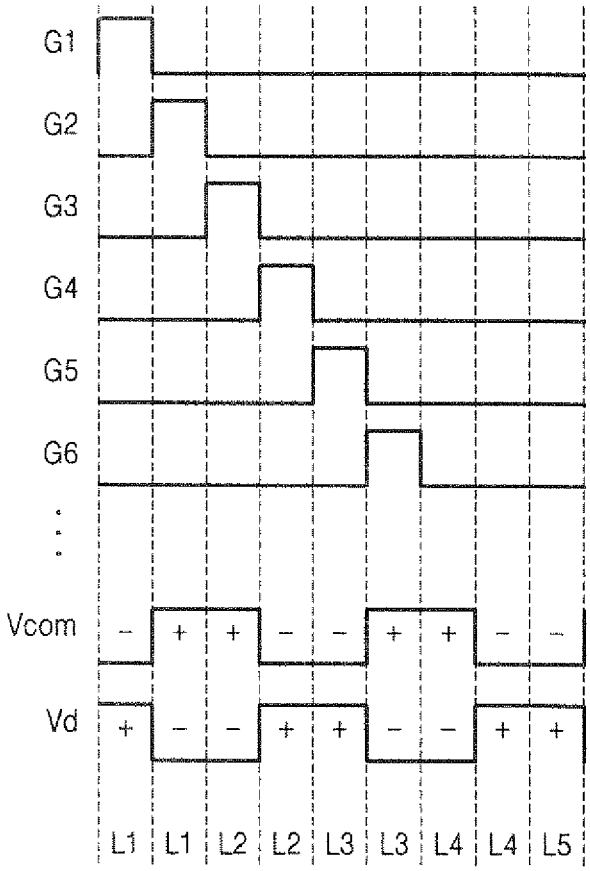
FIGS. 9A and 9B illustrate a method of driving a liquid crystal panel according to another embodiment of the present invention.
Figure 9B:
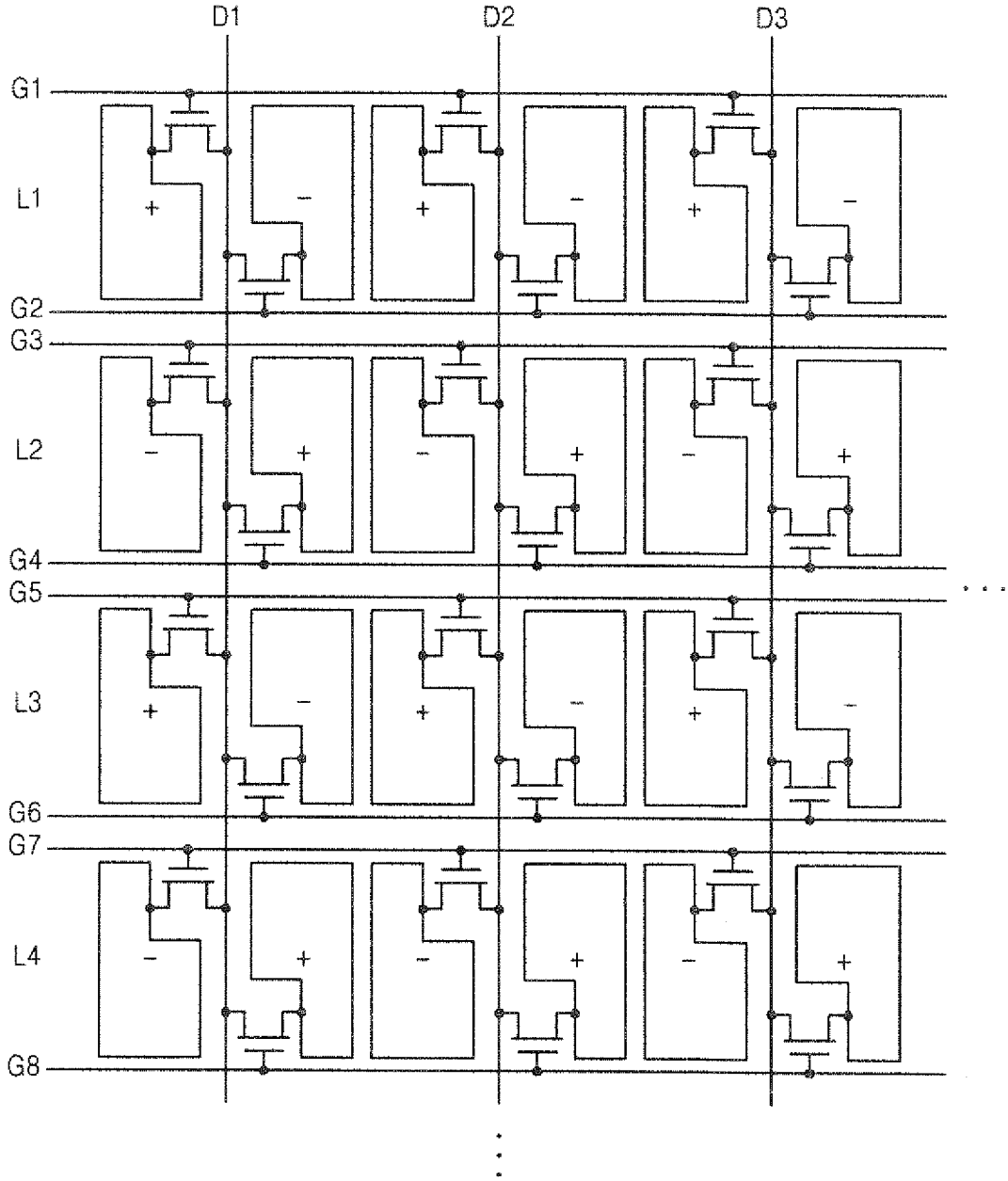

FIGS. 9A and 9B illustrate a method of driving a liquid crystal panel frame according to an embodiment of the present invention.

Referring to FIGS. 9A and 9B, a gate voltage Vg is sequentially applied from a first gate line G1 to an $n^{th}$ gate line Gn. In FIGS. 9A and 9B, for convenience, first thru eighth gate voltages, Vg1 thru Vg8, sequentially applied to first thru eighth gate lines, G1 thru G8, and first thru third data lines, D1 thru D3, are exemplarily illustrated.

The gate voltage Vg is sequentially applied from the first gate line G1, and thus a switching device is turned on, thereby applying a data voltage Vd to the first thru third data lines, D1 thru D3. Here, the output timing of a common voltage Vcom having a positive polarity (+) is shifted backwards by T/4, and the polarity of the data voltage Vd is reversed so that the data voltage Vd has an opposite polarity relative to the polarity of the shifted common voltage Vcom.

An inversion system according to an embodiment of the present invention will now be described with a pair of odd-numbered and even-numbered pixels connected to left and right sides of the first data line D1. This is equally applied to sub-pixels connected to the other data lines.

The common voltage Vcom having a negative polarity (−) and the data voltage Vd having a positive polarity (+) are applied to an odd-numbered sub-pixel connected to the first gate line G1 of a first horizontal line L1. The common voltage Vcom having a positive polarity (+) and the data voltage Vd having a negative polarity (−) are applied to an even-numbered sub-pixel connected to the second gate line G2 of the first horizontal line L1. The common voltage Vcom having a positive polarity (+) and the data voltage Vd having a negative polarity (−) are applied to an odd-numbered sub-pixel connected to the third gate line G3 of a second horizontal line L2. The common voltage Vcom having a negative polarity (−) and the data voltage Vd having a positive polarity (+) are applied to an even-numbered sub-pixel connected to the fourth gate line G4 of the second horizontal line L2.

Except for the common voltage Vcom and the data voltage Vd outputted to the odd-numbered sub-pixel connected to the first gate line G1, the common voltage Vcom and the data voltage Vd having the same type of polarities are subsequently outputted consecutively two times. Therefore, as shown in FIG. 9B, a dot inversion driving method of alternately applying the data voltage Vd having positive polarities (+) and negative polarities (−) between adjacent sub-pixels using the same power consumption as a line inversion driving method may be realized.

According to an embodiment of the present invention, a driving device of a line inversion system is used. Also, the output timing of a common voltage, the polarity of which is reversed, is shifted, and the polarity of a data voltage is reversed relative to the polarity of the common voltage, thereby realizing a dot inversion system of a liquid crystal panel.

As described above, an LCD according to the present invention realizes a liquid crystal panel in a dot inversion system using a driving device of a line inversion system to provide a high-quality image without an increase in the size of an integrated circuit (IC).

While the present invention has been particularly shown and described with reference to exemplary embodiments thereof, it will be understood by those of ordinary skill in the art that various changes in form and detail may be made therein without departing from the spirit and scope of the present invention as defined by the following claims.

What is claimed is:

1. A liquid crystal display (LCD), comprising:

a liquid crystal panel which includes a plurality of pairs of pixels which share a same data line and which are located between a pair of gate lines of one horizontal line;

a common voltage generator which outputs a common voltage signal having a polarity which is reversed one time for a period time, and repeated consecutively two times for a ½ period time;

a timing controller which outputs a common voltage control signal which shifts an output timing of the common voltage signal by a ¼ period time; and a source driver which synchronizes a data signal having a polarity opposite to the polarity of the common voltage with the output timing of the common voltage signal, and outputs the data signal to each data line;

wherein the period time is a time required for driving two horizontal lines.

2. The LCD of claim 1, wherein the pair of gate lines are formed in each horizontal line of the liquid crystal panel, wherein an odd-numbered one of the pair of pixels is connected to an odd-numbered one of the pair of gate lines, and an even-numbered one of the pair of pixels is connected to an even-numbered one of the pair of gate lines.

3. The LCD of claim 2, wherein each of the pixels is connected to the gate lines and the data line through a switching device.

4. The LCD of claim 1, wherein the common voltage signal is shifted ahead by a ¼ period time and then outputted.

5. The LCD of claim 1, wherein the common voltage signal is shifted backward by a ¼ period time and then outputted.

6. The LCD of claim 1, wherein the source driver outputs the data signal having a first polarity to a pixel connected to a first gate line, and alternately outputs the data signal having second and first polarities from a pixel connected to a second gate line, wherein the data signal having the second and first polarities is alternately outputted from the pixel connected to the second gate line consecutively two times.

7. The LCD of claim 1, wherein the source driver synchronizes the data signal of a line inversion system with the output timing of the common voltage signal, and outputs the data signal of the line inversion system.

8. A liquid crystal display (LCD), comprising:

a liquid crystal panel which comprises a plurality of pixels formed in intersection areas between a plurality of gate lines and a plurality of data lines, wherein a pair of adjacent pixels share a same data line and are located between a pair of gate lines of one horizontal line;

a common voltage generator which shifts by a ¼ period time and outputs a common voltage signal having a polarity which is reversed one time for a period time and repeated consecutively two times for a ½ period time; and a source driver which synchronizes a data signal of a line inversion system with an output timing of the common voltage signal, and outputs the data signal with one of a positive polarity and a negative polarity opposite to the polarity of the common voltage signal so as to drive the plurality of pixels in a dot inversion system;

wherein the period time is a time required for driving two horizontal lines.

9. The LCD of claim 8, wherein the pair of gate lines are formed in each horizontal line of the liquid crystal panel, wherein an odd-numbered one of the pair of pixels is connected to an odd-numbered one of the pair of gate lines, and an even-numbered one of the pair of pixels is connected to an even-numbered one of the pair of gate lines.

10. The LCD of claim 8, wherein the common voltage generator outputs the common voltage signal which is shifted ahead by a ¼ period time according to the common voltage control signal.

11. The LCD of claim 8, wherein the common voltage generator outputs the common voltage signal which is shifted backward by a ¼ period time according to the common voltage control signal.

12. The LCD of claim 8, further comprising a timing controller which outputs a common voltage control signal which shifts the output timing of the common voltage signal.

13. A method of driving a liquid crystal display (LCD) comprising a liquid crystal panel which includes a plurality of pixels formed in intersection areas between a plurality of gate lines and a plurality of data lines, wherein a pair of adjacent pixels share the same data line and are located between a pair of gate lines of one horizontal line, said method comprising the steps of:

outputting a gate signal sequentially to the plurality of gate lines;

shifting a common voltage signal by a ¼ period time, the common voltage signal having a polarity which is reversed one time for a period time and repeated consecutively two times for a ½ period time;

outputting the shifted common voltage signal to a pixel turned on by the gate signal; and synchronizing a data signal having an opposite polarity relative to a polarity of the common voltage signal with an output timing of the common voltage signal, and outputting the data signal to the plurality of data lines;

wherein the period time is a time required for driving two horizontal lines.

14. The method of claim 13, wherein the pair of gate lines are formed in each horizontal line of the liquid crystal panel, wherein an odd-numbered one of the pair of pixels is connected to an odd-numbered one of the pair of gate lines, and an even-numbered one of the pair of pixels is connected to an even-numbered one of the pair of gate lines.

15. The method of claim 13, wherein the common voltage signal is shifted and outputted ahead by a ¼ period time according to the common voltage control signal.

16. The method of claim 13, wherein the outputting of the data signal comprises outputting the data signal having a first polarity to a pixel connected to a first gate line, and alternately outputting the data signal having second and first polarities from a pixel connected to a second gate line, wherein the data signal having the second and first polarities is alternately outputted from the pixel connected to the second gate line consecutively two times.

* * * * *